US006675461B1

(12) United States Patent
Rowson et al.

(10) Patent No.: US 6,675,461 B1
(45) Date of Patent: Jan. 13, 2004

(54) METHOD FOR MANUFACTURING A MAGNETIC DIPOLE ANTENNA

(75) Inventors: Sebastian Rowson, Santa Monica, CA (US); Laurent Desclos, Los Angeles, CA (US); Gregory Poilasne, Los Angeles, CA (US)

(73) Assignee: Ethertronics, Inc., San Diego, CA (US)

( * ) Notice: Subject to any disclaimer, the term of this patent is extended or adjusted under 35 U.S.C. 154(b) by 0 days.

(21) Appl. No.: 09/891,971

(22) Filed: Jun. 26, 2001

(51) Int. Cl.[7] ..... H01P 11/00; H01Q 13/00

(52) U.S. Cl. ..... 29/600; 29/601; 29/593; 29/239; 29/253; 29/254; 343/700 MS; 343/741; 343/748; 343/750; 254/104

(58) Field of Search ..... 29/600, 601, 593, 29/239, 254, 253; 343/741, 748, 750, 866, 700 MS; 254/104

(56) References Cited

U.S. PATENT DOCUMENTS

| | | | | | |
|---|---|---|---|---|---|
| 3,896,545 | A | * | 7/1975 | MacTurk | 29/600 |
| 4,433,463 | A | * | 2/1984 | DuVal | 29/239 |
| 5,146,232 | A | * | 9/1992 | Nishikawa et al. | 343/713 |
| 5,508,474 | A | * | 4/1996 | Tumura | 84/726 |
| 5,526,007 | A | * | 6/1996 | Murakami et al. | 343/741 |
| 5,557,444 | A | * | 9/1996 | Melville et al. | 359/199 |
| 5,592,182 | A | * | 1/1997 | Yao et al. | 343/742 |
| 5,659,324 | A | * | 8/1997 | Taniguchi et al. | 343/713 |
| 5,781,110 | A | * | 7/1998 | Habeger et al. | 340/572.5 |
| 5,952,982 | A | * | 9/1999 | Jorgenson et al. | 343/797 |
| 6,014,107 | A | * | 1/2000 | Wiesenfarth | 343/742 |
| 6,057,053 | A | * | 5/2000 | Gibb | 429/37 |
| 6,091,364 | A | * | 7/2000 | Murakami et al. | 343/700 MS |
| 6,297,777 | B1 | * | 10/2001 | Tsubaki et al. | 343/700 MS |
| 6,329,955 | B1 | * | 12/2001 | McLean et al. | 343/742 |
| 6,515,630 | B2 | * | 2/2003 | Honda | 343/702 |

FOREIGN PATENT DOCUMENTS

JP 62255876 A * 11/1987

* cited by examiner

*Primary Examiner*—Peter Vo
*Assistant Examiner*—Paul Kim
(74) *Attorney, Agent, or Firm*—Foley & Lardner

(57) ABSTRACT

A method for manufacturing a magnetic dipole antenna employing one or more spacers is disclosed. The magnetic dipole antenna having three plates, where each plate has holes for inserting one or more spacers through the bottom and middle plates. The distance separation between the top plate and the middle plate of the magnetic dipole antenna determines the operational frequency. Spacers are used to adjust and secure gap between top and middle plates and fix operational frequency of antenna at desired target frequency. A coaxial cable is attached to the magnetic dipole antenna for measuring the resonant frequency.

5 Claims, 14 Drawing Sheets

METHOD FOR MANUFACTURING A MAGNETIC DIPOLE ANTENNA

CROSS REFERENCE TO RELATED APPLICATION

This application relates to a co-pending U.S. patent application Ser. No. 09/781,720, entitled "Magnetic dipole antenna and method" by Eli Yablonovitch et al., filed on Feb. 12, 2001, owned by the assignee of this application and incorporated herein by reference.

BACKGROUND INFORMATION

1. Field of the Invention

The present invention relates generally to the field of wireless communication, and particularly to the manufacturing of an antenna.

2. Description of Related Art

The precision on the physical dimensions of an antenna is dictated by its bandwidth compared to the targeted application's bandwidth. In the case of very high Q antennas such as the magnetic dipole antenna (MDA) (may be extended to capacitively loaded antennas), these tolerances can lead to structures non manufacturable at high volume. A rough "best case" estimate of the dimension tolerances allowed is given by the relative bandwidth that is 1% for a MDA. These structures typically have sub-nillimeter dimensions that have to be maintained over surfaces of hundreds ofsquare millimeters. This leads to fabrication tolerances in the micron range that are not achievable with standard low cost readily available technologies.

Accordingly, the present invention addresses a method to automatically manufacture MDAs while using low tolerance parts available at low cost.

SUMMARY OF THE INVENTION

The present invention discloses an apparatus and method for manufacturing a magnetic dipole antenna employing one or more spacers. The basic antenna is composed by three plates that could be of any form. The antenna could have some features such as holes or other placing features but not necessarily. In one embodiment, a magnetic dipole antenna (MDA) has three plates, where each plate has holes for inserting one or more spacers through the bottom and middle plates. The distance between the top plate and the middle plate of the magnetic dipole antenna determines the operational frequency. A feeding structure, e.g. a coaxial cable, is attached to the magnetic dipole antenna for measuring the resonant frequency.

A tuning machine, either manual or automated, for adjusting the separation between the top and middle plates or planes using spacers as actuators. Each spacer has an external body surface and an internal hollow core, where the external body surface contains apertures. After a desirable separation between the top and middle plates is achieved, as determined by a test measurement, the spacers are secured by injecting adhesive through the internal hollow core that extends to the apertures in the external body surface.

Other structures and methods are disclosed in the detailed description below. This summary does not purport to define the invention. The invention is defined by the claims.

BRIEF DESCRIPTION OF THE DRAWINGS

FIGS. 5B1, 5B2, and 5B3 are structural diagrams illustrating, respectively, a top view of the top plate, the middle plate, and the bottom plate.

DETAILED DESCRIPTION OF PREFERRED EMBODIMENT(S)

Figure 1:
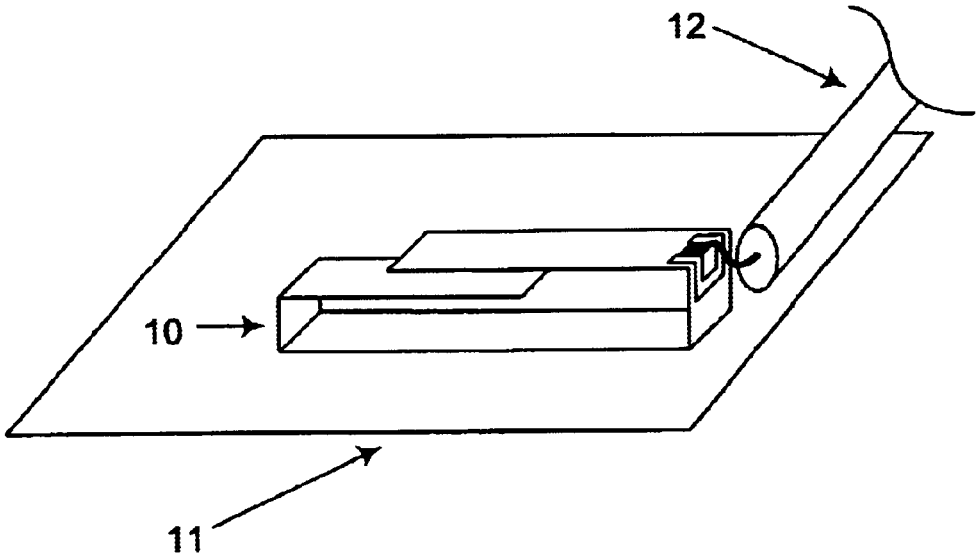
FIG. 1 is a structural diagram illustrating a magnetic dipole antenna placed on a ground plane and attached to a coaxial cable in accordance with the present invention.
Figure 2:
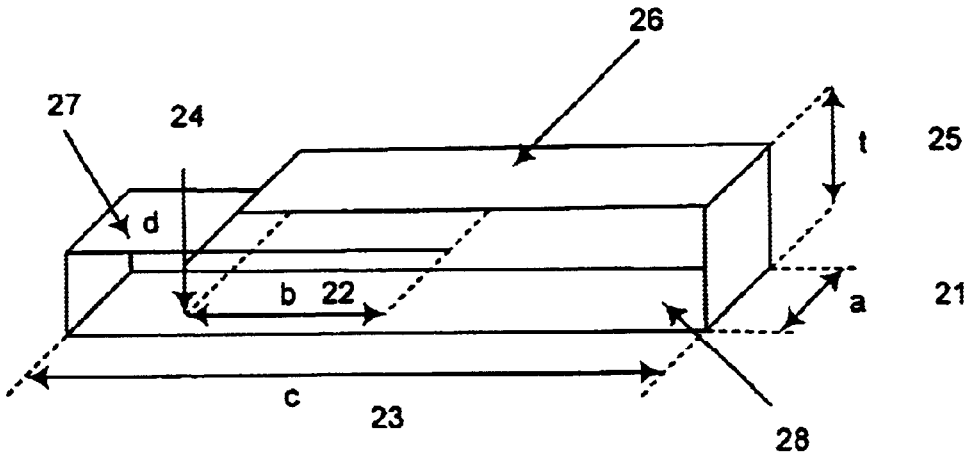
FIG. 2 is a structural diagram illustrating the physical dimension of the magnetic dipole antenna in accordance with the present invention.

FIG. 1 is a structural diagram illustrating a magnetic dipole antenna 10 placed on a ground plane 11 and attached to a coaxial cable 12. It is noted that anything above the ground plane 11, close to the magnetic dipole antenna 10, changes its characteristics. FIG. 2 defines the physical dimensions of the magnetic antenna 10, denoted by a set of parameters including a 21, b 22, c 23, d 24, t 25. The resonant frequency of the magnetic dipole antenna 10 can be estimated using the dimensions as shown below to calculate an inductor (L) and a capacitor (C) in an equivalent electrical circuit.

$$f = \frac{1}{2\pi\sqrt{LC}} \text{ with } L = \mu t\left(\frac{c}{a}\right) \text{ and } C = \varepsilon\frac{ab}{d} \text{ thus } f = \frac{1}{2\pi\sqrt{\varepsilon\mu\frac{cbt}{d}}} \quad \text{[Eq. 1]}$$

Figure 3A:
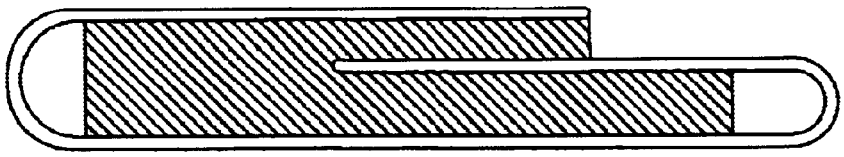
FIGS. 3A, 3B, and 3C are structural diagrams illustrating various embodiments of spacer geometry in a magnetic dipole antenna in accordance with the present invention.
Figure 3B:
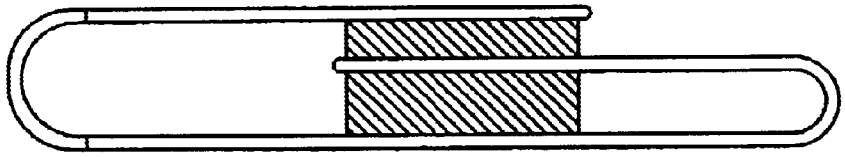
Figure 3C:
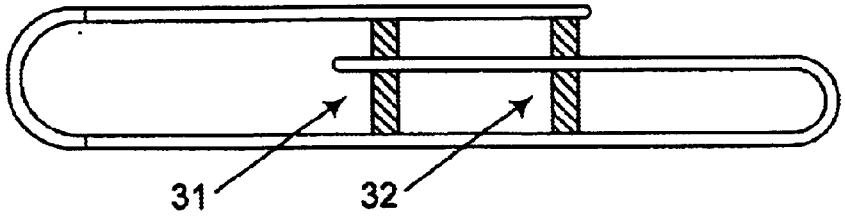

The capacitor C is created by the overlap of a top plate 26 and a middle plate 27. L is related to the overall length of the metal for building the magnetic dipole antenna 10. For GPS (Global Positioning System) applications, the functional frequency is 1.575 GHz. Typical antenna dimensions to reach this frequency are, for example, c 23=25 mm, b 22=9 mm, t 25=2.5 mm and d 24=0.7 mm. The bandwidth of this type of antenna is roughly 12 MHz. Using Eq.1 shows that the tolerances on the dimensions to ensure coverage of the GPS frequency are under 1%. For example, one efficient approach to manufacture large quantities of the metal structure is shown in FIG. 2 with four slide forming. The typical precision obtained with this technology is 0.1 mm whereas 1% of d is 0.007 mm. Consequently, a freestanding metal structure might be difficult to be used To maintain the gap d between the two top metal plates, spacers are used as shown in FIGS. 3A, 3B, 3C. The dielectric losses of the material in the gap can degrade the efficiency of the antenna For this reason, it is desirable to introduce the minimum volume of dielectric possible in making solution as shown in FIG. 3C. Although it is possible to manufacture spacers 31 and 32 with the required tolerances, assembling the different parts may not necessarily produce a structure resonating at the targeted frequency, such as the configuration shown in FIG. 3C, where the spacing is maintained locally and bending of the metal can not be controlled over the whole surface of the capacitor.

The magnetic dipole antenna 10 is constructed using parts with low dimension tolerances. The operating frequency is achieved by mechanically adjusting the gap d while electrically measuring the resonant frequency of the structure. This results in 100% or substantially complete success and eliminates the need of a testing/qualifying procedure after the antenna fabrication. This reduces the final production cost for two reasons. First high precision parts are not required. Secondly, the additional cost and time of a test procedure is suppressed. During the tuning process the antenna is placed in a working configuration such as in FIG. 1 (i.e. no parts above the ground plane close to the antenna creating interferences).

Figure 4A:
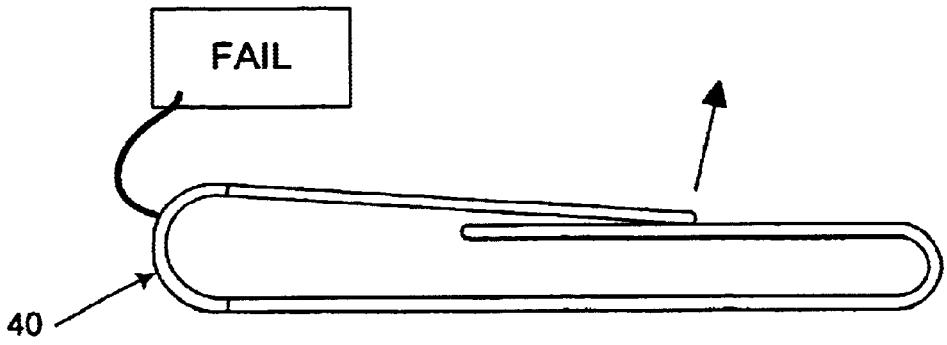
FIG. 4A is structural diagram illustrating the process for commencing the tuning ;mechanism.
Figure 4B:
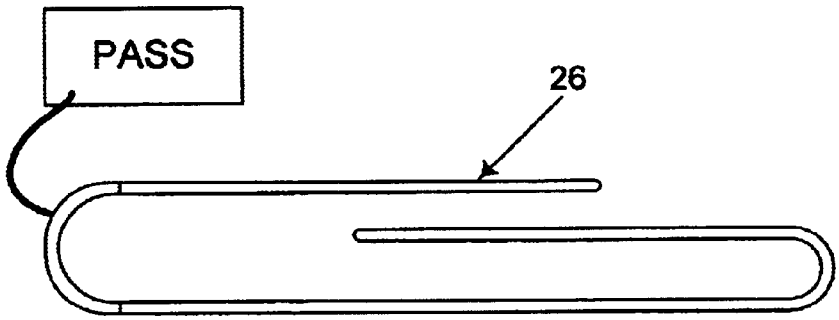
FIG. 4B is structural diagram illustrating the process of the tuning mechanism for lifting a top plate until the device passes the test.
Figure 4C:
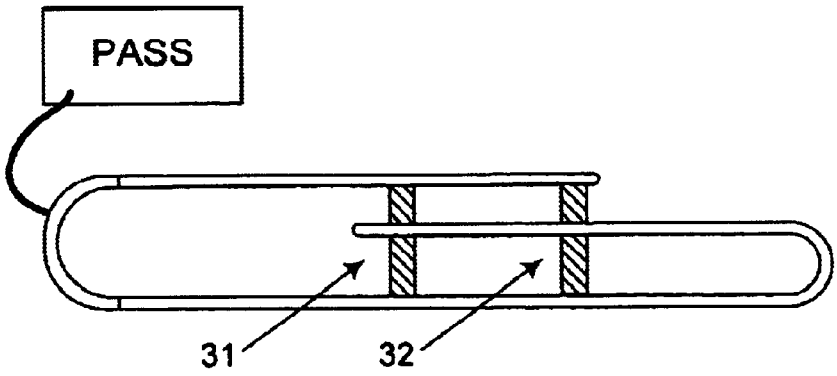
FIG. 4C is structural diagram illustrating the process of the tuning mechanism for inserting spacers to secure the magnetic dipole antenna in accordance with the present invention.

FIG. 4A is structural diagram illustrating the configuration at the beginning of the tuning mechanism process. A metal part 40 of the magnetic dipole antenna 10 is fabricated to insure a gap that is too small so that the magnetic dipole antenna 10 operates at a frequency lower than desired one and fails the test procedure. Then, the gap is gradually increased by lifting the top plate 26 of the magnetic dipole antenna structure 10 until the right frequency is hit, as illustrated in FIG. 4B. Finally, as shown in FIG. 4C, the spacers 31 and 32 are secured in the magnetic dipole antenna structure 10 and the resonant frequency is measured for pass or fail.

Figure 5A:
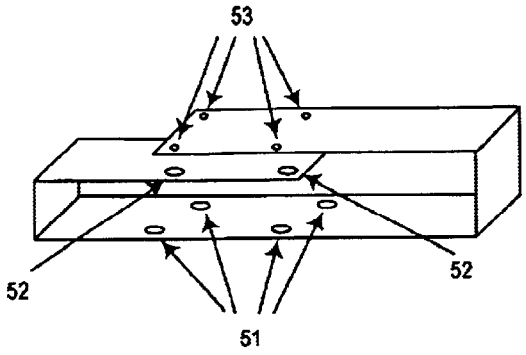
FIG. 5A is a structural diagram illustrating a three-dimensional view of the magnetic dipole antenna with holes through the metal plates for placement of spacers.
Figure 5C:
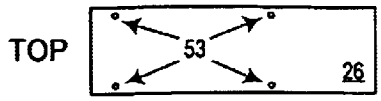
FIG. 5C is a structural diagram illustrating a spacer geometry.
Figure 5C:
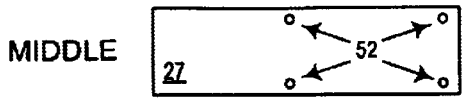
Figure 5C:
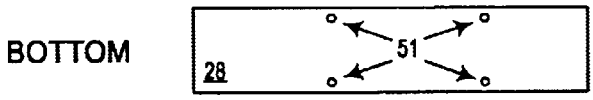
Figure 5C:
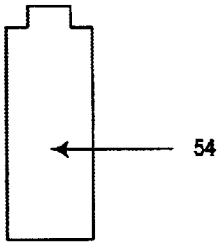
Figure 5D:
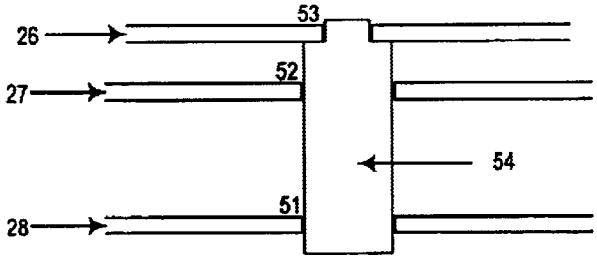
FIG. 5D is a structural diagram illustrating the positioning of the top, middle, and bottom plates relative to a spacer in accordance with the present invention.

The automated device described further on in this invention requires the metal part 40 of the magnetic dipole antenna 10 to be formed as shown in FIG. 5A. FIGS. 5B1, 5B2, and 5B3 show a top view, respectively, of the top plate, the middle plate, and the bottom plate. Four large diameter holes 51 go through the bottom plate 28, four large diameter holes 52 go through the middle plate 27, and four smaller diameter holes 53 go through the top layer 26. A spacer 54 is of cylindrical shape with a shoulder as shown in FIG. 5C. The spacer 54 serves as a mechanical actuator for lifting the top plate 26. To increase the gap, the spacer 54 is pushed through the bottom plate 28 of the magnetic dipole antenna 10. The spacer 54 moves freely through the bottom plate 28 and the middle plate 27, the shoulder catches the top plate 26 and pushes the top plate 26 up therefore increasing the spacing between the top plate 26 and the middle plate 27. FIG. 5D shows the positioning of the spacer 54 relative to the top plate 26, the middle plate 27, and the bottom plate 28. One of ordinary skill in the art should recognize that other equivalent or similar terms in characterizing the spacing, such as gap, separation, distance, can be practiced without departing from the spirits in the present invention.

Figure 6:
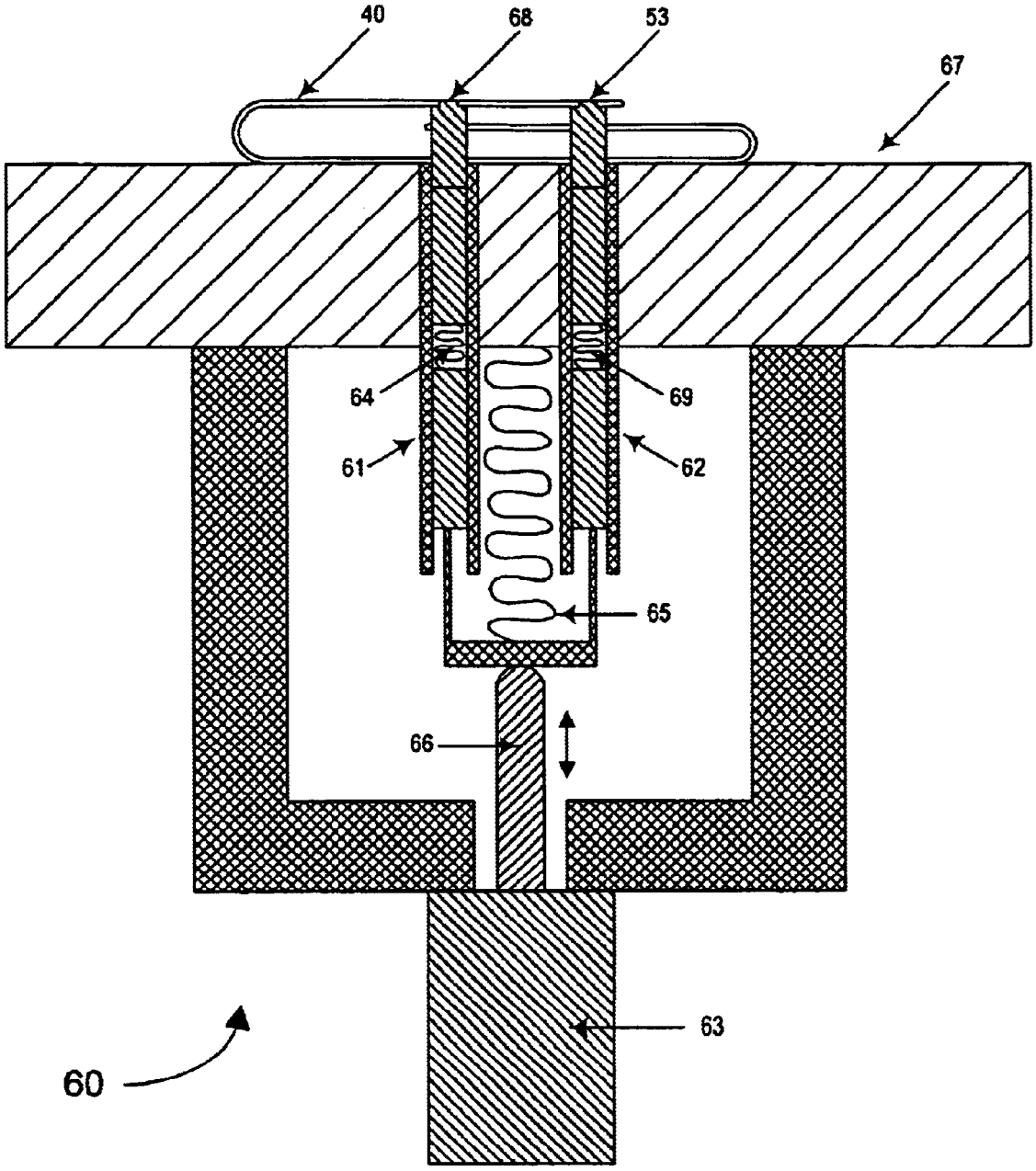
FIG. 6 is a structural diagram illustrating a tuning machine for inserting spacers into the magnetic dipole antenna.

A tuning machine 60 for pushing spacers into the magnetic dipole antenna 10 is shown in FIG. 6. The spacers 54 is placed in four piston-like structures II (only pistons 61 and 62 are shown). The four pistons are operated simultaneously using a linear motor 63. A spring 64 ensures that even pressure is applied to a spacer 68, and a spring 69 ensures that even pressure is applied to the spacer 54. A spring 65 provides reaction against a translation rod 66.

Figure 7A:
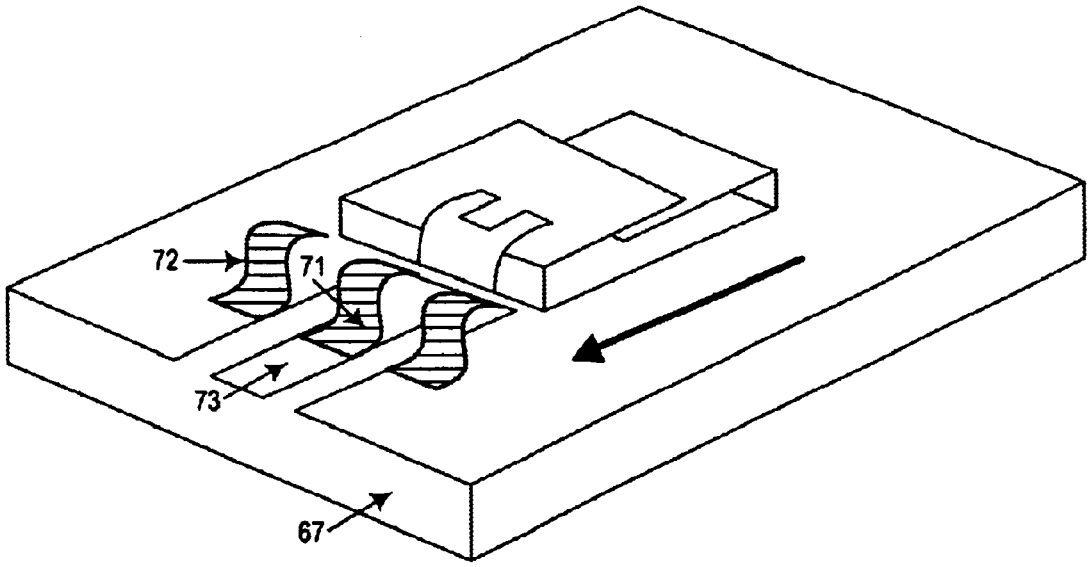
FIG. 7A is a structural diagram illustrating the configuration prior to attaching two springs for connection to ground plane, and one spring for connecting a testing device.
Figure 7B:
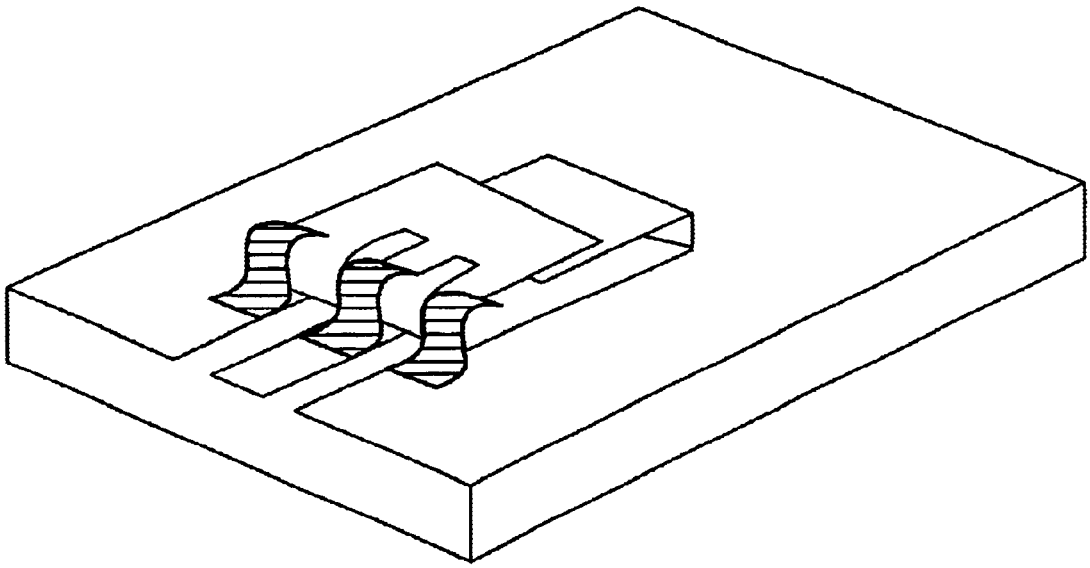
FIG. 7B is a structural diagram illustrating the configuration for connecting the two springs to the ground plane, and for connecting one spring to a testing device in accordance with the present invention.

FIG. 7A is a structural diagram that shows a part of the testing apparatus which can be used to connect to a measurement system. Three metal pieces represent as springs. One center spring will be connected to the center of a coplanar waveguide structure. The two others will be connected to ground. FIG. 7A illustrates the structure and the antenna before the antenna is slid beneath the springs. FIG. 7B is a diagram showing the antenna slid under the springs. The contact between the feeding points and the middle spring and the two springs connected to ground linking to the side of the antenna.

Electrical contact to the magnetic dipole antenna 10 is provided by a contact 71 that along with a clip 72 also maintains the magnetic dipole antenna 10 in position during the tuning process. The magnetic dipole antenna 10 could also be maintained using a vacuum system. A transmission line 73 goes from the contact 71 to the test equipment (external network analyzer, not shown).

Figure 8A:
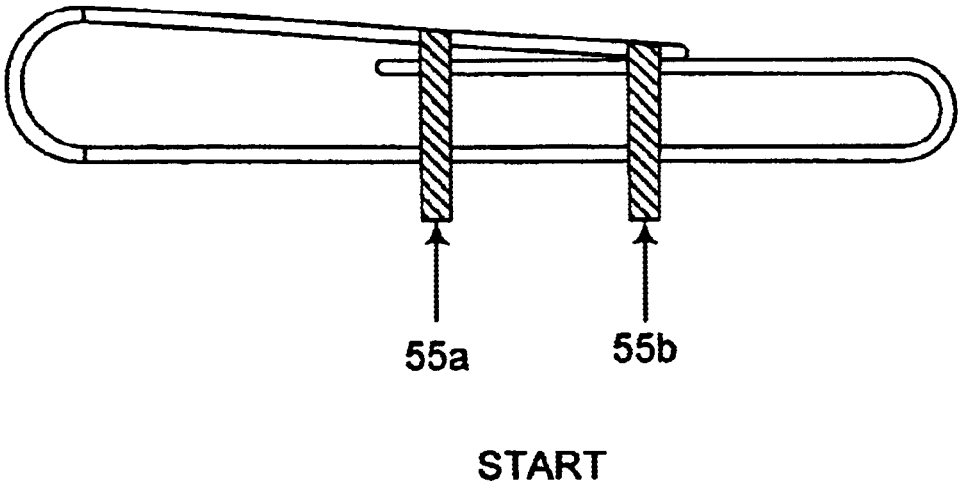
FIG. 8A is a structural diagram illustrating the spacer position prior to the frequency adjustment process.
Figure 8B:
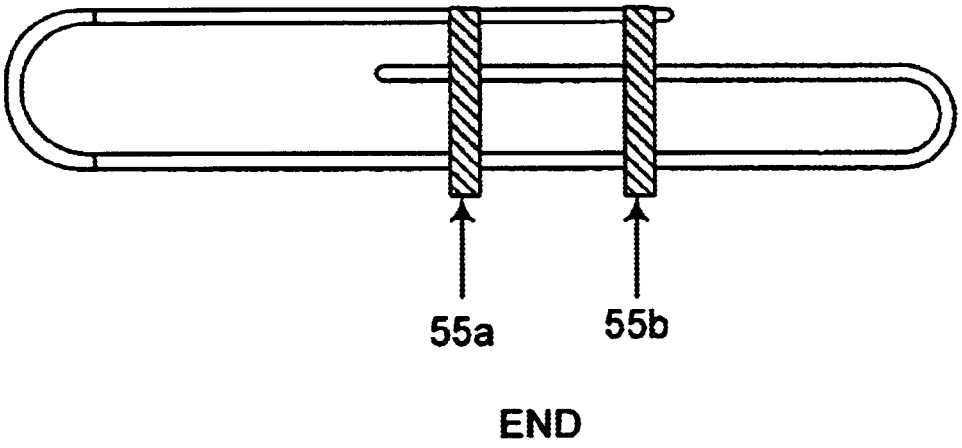
FIG. 8B is a structural diagram illustrating the spacer position after the adjustment process.

FIG. 8A is a structural diagram illustrating the spacer position prior to locating the frequency of the magnetic dipole antenna. After locating the frequency, the position of the top plate 26 is shown in FIG. 8B, where the spacers 54 and 68 extends through the middle plate 27 in lifting the top plate 26 to create a desirable gap between the top plate 26 and the middle plate 27.

Figure 9A:
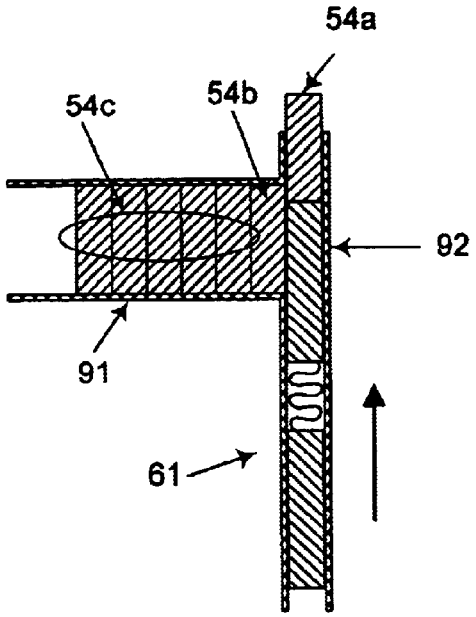
FIGS. 9A–9D are structural diagrams for automating the delivering of spacers to the tuning machine in accordance with the present invention.
Figure 9B:
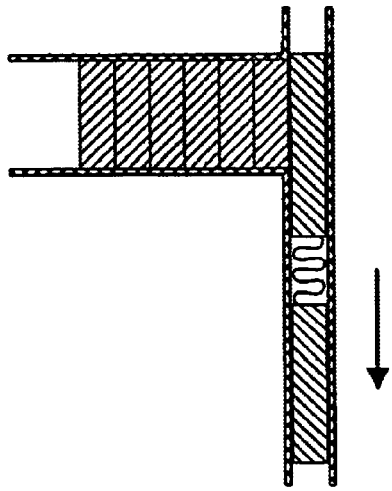
Figure 9C:
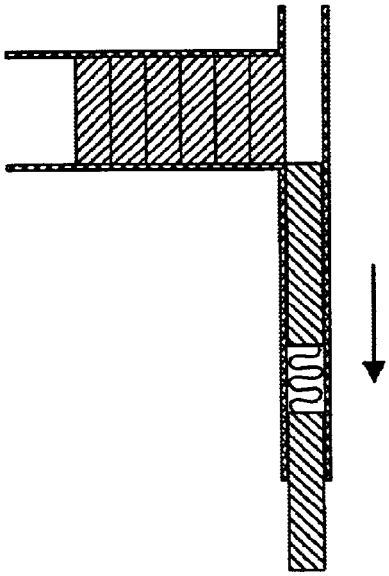
Figure 9D:
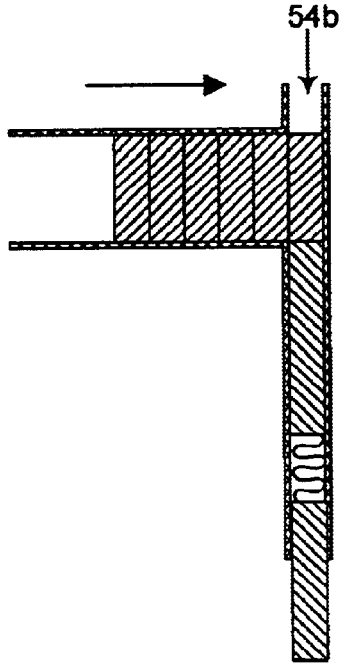

Standard off the shelf pick and place mechanisms can be used to position and remove the magnetic dipole antenna 10 at the beginning and the end of the process. A system for automating the delivering of spacers to the tuning machine is shown FIGS. 9A–9D. The spacers 54*a* and 54*b* are placed in a guiding tube 91, a force (spring, compressed air) pushes the spacers 54*b* and 54*c* towards the vertical tuning piston 61. FIG. 9A shows the beginning of the cycle with the spacer 54*a* loaded in the tuning tube 61. The spacer 54*a* is pushed until the right frequency is achieved. Then, the structure is secured and removed from the tuning machine 60, leaving the tuning piston tube 61 empty, as illustrated in FIG. 9B. A tuning piston 92 is then brought down below the opening in its side, as shown in FIG. 9C, and a new spacer (the spacer 54*b*) is pushed into the piston, as shown in FIG. 9D. During this process, a new metal part is inserted on the top. The spacer is brought up and the tuning cycle can begin, as shown in FIG. 9A.

Figure 10A:
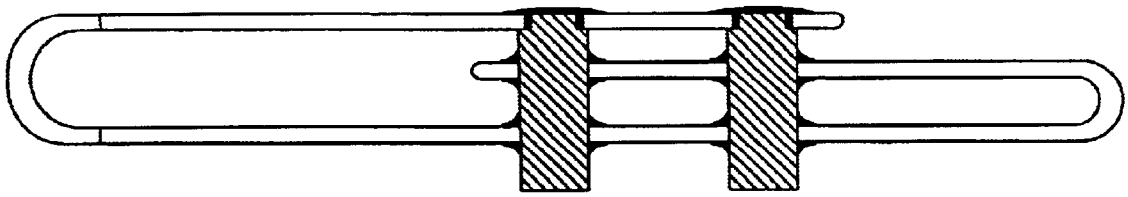
FIG. 10A is a structural diagram illustrating gluing the spacers to the metal of the magnetic dipole antenna.
Figure 10B:
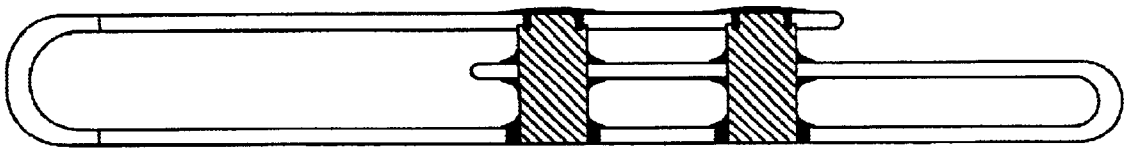
FIG. 10B is a structural diagram illustrating the trimming of the excess in the spacers in which the bottom ends of the spacers are flush with the bottom plate of the magnetic dipole antenna in accordance with the present invention.

FIG. 10A is a structural diagram illustrating gluing the spacers to the metal of the magnetic dipole antenna. UV curable adhesives is a suitable choice since they can be cured extremely rapidly. The remaining parts of the spacers can either be removed, as shown in FIG. 10B, or kept for mounting and position on a host printed circuit board (not shown). Off the shelf adhesive dispensers could be used. Nevertheless, the dispensing device should remain far (several wavelengths) from the magnetic dipole antenna 10 to avoid interferences during the tuning process and be brought into place after the tuning process. This could cause difficulties in positioning the dispensing device and slow down the process. The UV light source can be placed far enough away as to not disturb the tuning process and still cure the adhesive efficiently.

Figure 11A:
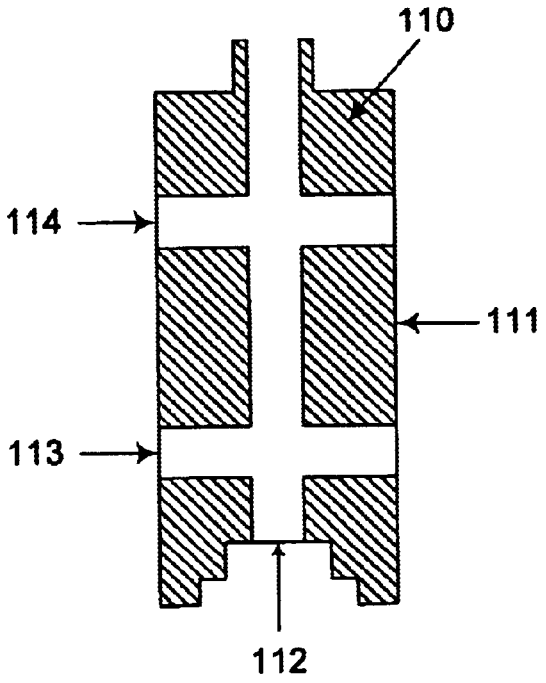
FIG. 11A is a structural diagram illustrating a two-dimensional view a spacer s geometry.
Figure 11B:
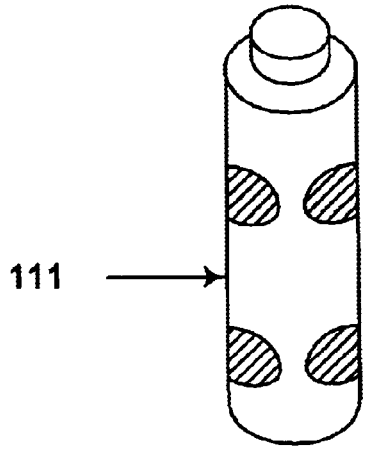
FIG. 11B is a structural diagram illustrating a three-dimensional view a spacer geometry.
Figure 11C:
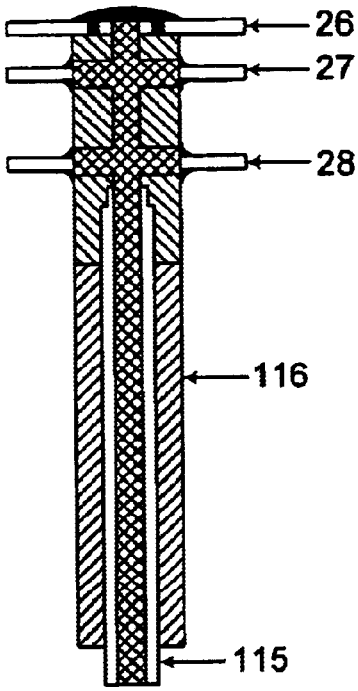
FIG. 11C is a structural diagram illustrating a two-dimensional view for injecting adhesive through the spacer that extends to the top, middle, and bottom plates of the magnetic dipole antenna in accordance with the present invention.

FIG. 11A is a structural diagram illustrating a two-dimensional view of a spacer geometry, with a three-dimensional view of a spacer geometry shown in FIG. 11B. A spacer 110 has an exterior body surface 111 and a hollow 112 with a hole from top to bottom. Holes are pierced perpendicularly to the main center one at the estimated position of the bottom plate 28 and the middle plate 27. One of ordinary skill in the art should recognize that holes may be aligned with the main center at an angle that is not perpendicular. FIG. 11C is a two-dimensional structural diagram illustrating the injection of adhesive through the spacer that extends to the top, middle, and bottom plates of the magnetic dipole antenna. Once the spacer 110 is in place, the adhesive is injected through the hollow 112 from the bottom of the spacer 110, as shown in FIG. 11C. The adhesive is brought to the spacer 110 in a tube 115 that goes through a tuning piston 116. The adhesive is then cured with a UV source. This solution eliminates problems of devices over the ground plane interfering with the tuning and easily provides precise application of the adhesive. To accelerate further more the process full curing of the adhesive can be obtained later in a multi part annealing process.

Although the magnetic dipole antenna is illustrated above for using spacers to tune the antenna, the principle disclosed in this invention is equally applicable to other types of antennas.

Figure 12:
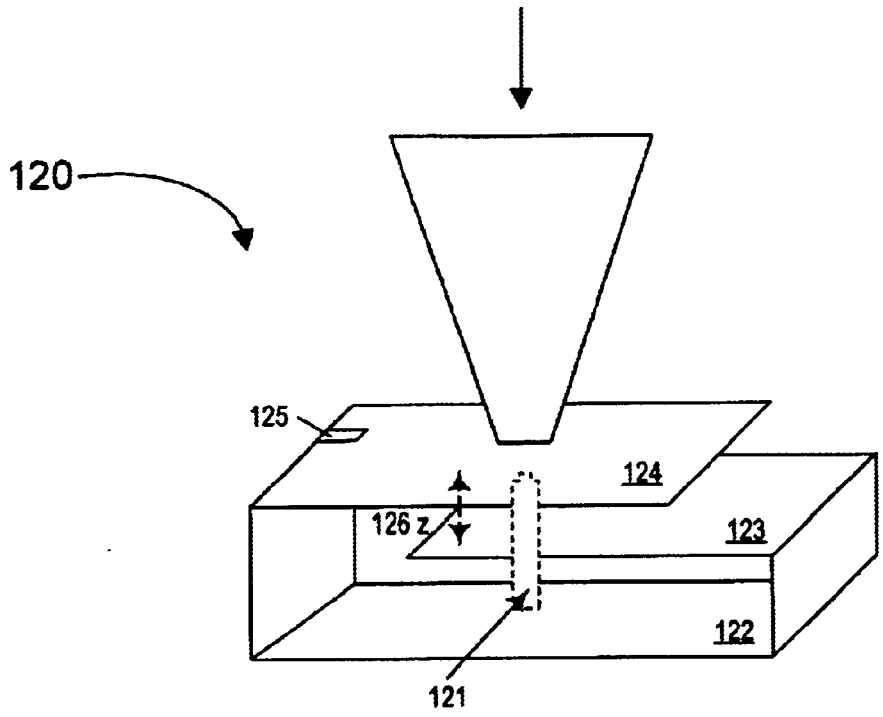
FIG. 12 is a structural diagram of a magnetic dipole antenna that employs a pressure element for finding a desirable frequency with a glued spacer in accordance with the present invention.

FIG. 12 is a structural diagram of a magnetic dipole antenna 120 that employs a pressure element for finding a desirable frequency with a glued spacer. A spacer 121 is inserted through a bottom plate 122, a middle plate 123, and a top plate 124. The magnetic dipole antenna 120 has a transmission line 125 connected to a test equipment (not shown) for measuring the frequency produced from a gap, z 126, between the top plate 124 and the middle plate 123. A pressure element 127 exerts force upon the top plate 124 of the magnetic dipole antenna 120 for tuning, until a desirable frequency is measured by the test equipment. After the desirable frequency is detected, the pressure pusher 127 maintains the top plate 124 in position, while glue is cured on the spacer 121 to hold the gap 126 in place between the top plate 124 and the middle plate 123. The pressure element 127 could be transparent to electromagnetic wave such as Teflon.

Figure 13:
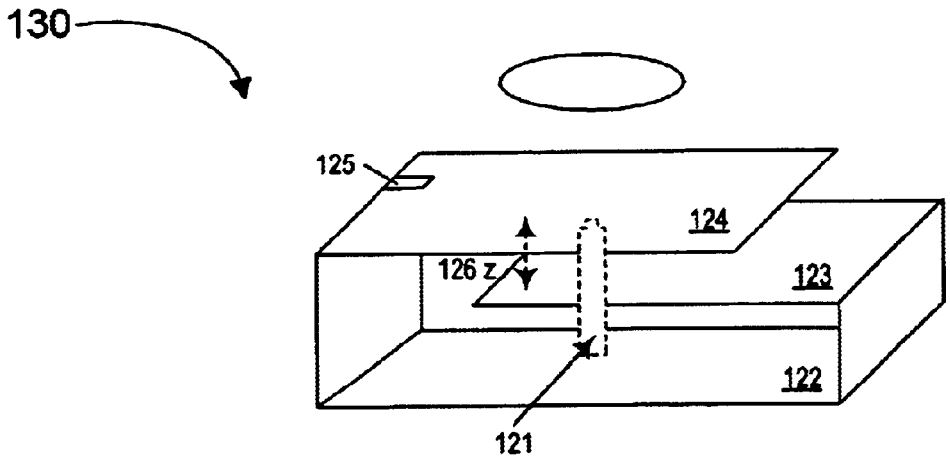
FIG. 13 is a structural diagram employs a magnet for finding a desirable frequency with a glued spacer in accordance with the present invention.

FIG. 13 is a structural diagram in which a magnet for finding a desirable frequency with a glued spacer is employed. The spacer 121 is inserted through a bottom plate 122, the middle plate 123, and the top plate 124. The magnetic dipole antenna 130 has the transmission line 125 that is connected to a test equipment (not shown) for measuring the frequency produced from the gap, z 126, between the top plate 124 and the middle plate 123. A magnet 131, electromagnet, or a material that produces magnetic attraction, exerts force upon the top plate 124 of the magnetic dipole antenna 130 for tuning, until a desirable frequency is measured by the test equipment. The top plate 124 is coated partially with material that can be attracted by a magnetic field. The coat material over the top plate 124 can be strips of metals, or footprints of metals. After the desirable frequency is detected, the magnet 131 maintains the top plate 124 in position, while glue is cured on the spacer 121 to hold the gap 126 in place between the top plate 124 and the middle plate 123.

Figure 14:
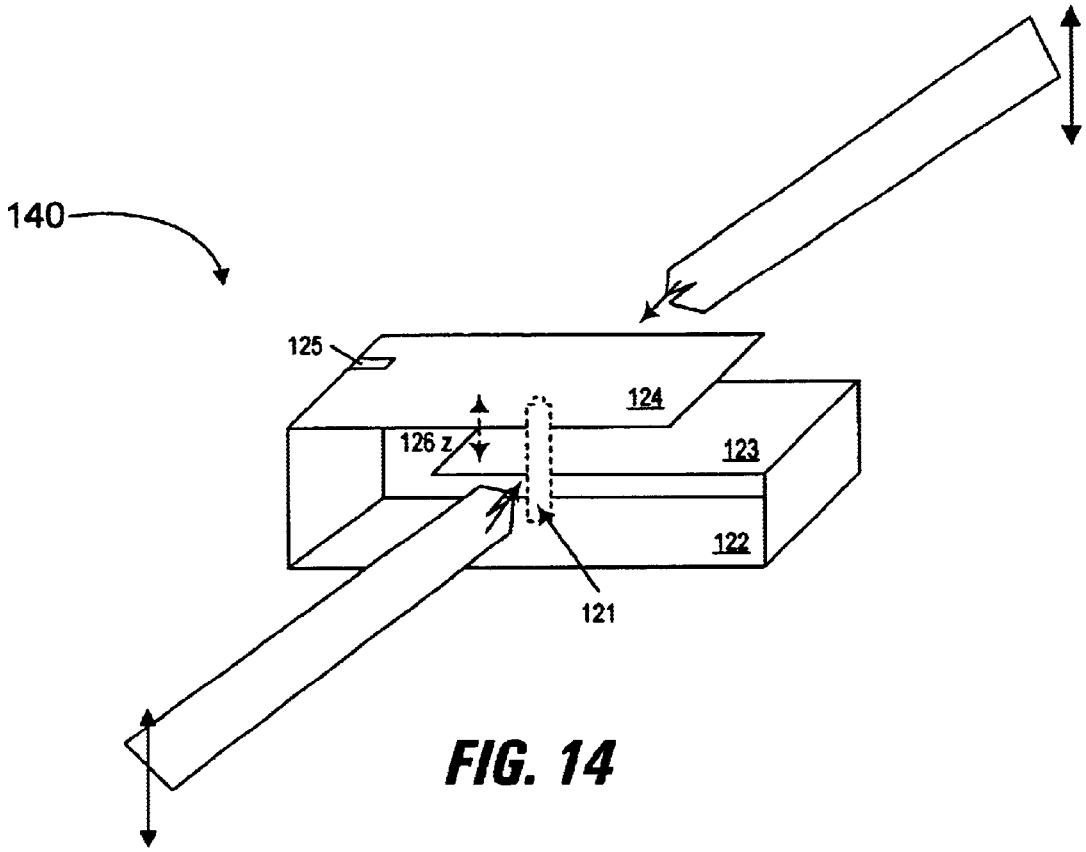
FIG. 14 is a structural diagram employs a pair of wedges with slits positioned angularly toward the top plate and the middle plate for finding a desirable frequency with a glued spacer in accordance with the present invention.

FIG. 14 is a structural diagram in which we see a pair of wedges with slits positioned angularly toward the top plate and the middle plates for finding a desirable frequency with a glued spacer. The spacer 121 is inserted through a bottom plate 122, the middle plate 123, and the top plate 124. The magnetic dipole antenna 140 has the transmission line 125 that is connected to a test equipment (not shown) for measuring the frequency produced from the gap, z 126, between the top plate 124 and the middle plate 123. A pair of wedges 141 and 142 are used to exert force upon the top plate 124 and the middle plate 123, respectively, until a desirable frequency is measured by the test equipment. The wedge 141 has a slit 143 at one edge for positioning against the top plate 124, while the wedge 142 also has a slit 144 at one edge for positioning against the middle plate 123. After the desirable frequency is detected, the pair of wedges 141 and 142 maintain the top plate 124 and the middle plate 123 in position, while glue is cured on the spacer 121 to hold the gap 126 in place between the top plate 124 and the middle plate 123.

Figure 15:
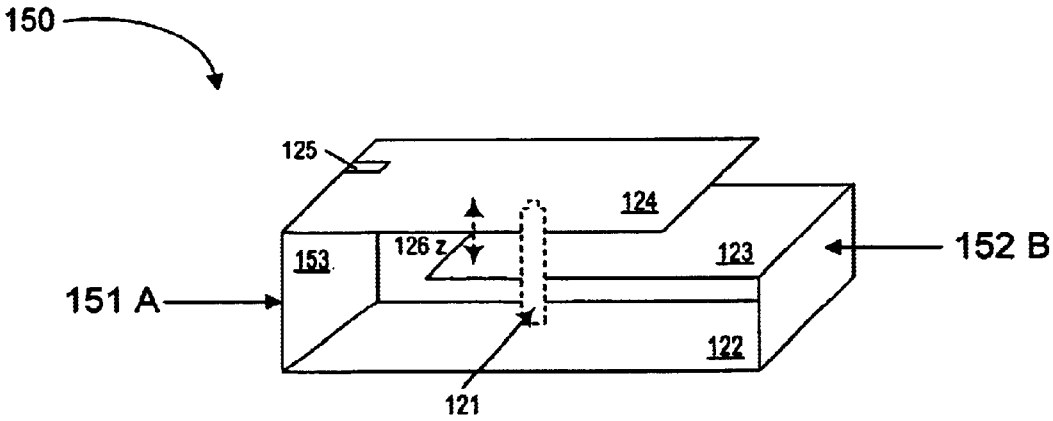
FIG. 15 is a structural diagram employs a pair of wedges for pressuring sidewalls for finding a desirable frequency with a glued spacer in accordance with the present invention.

FIG. 15 is a structural diagram in which we see a pair of wedges for pressuring sidewalls for finding a desirable frequency with a glued spacer. The spacer 121 is inserted through a bottom plate 122, the middle plate 123, and the top plate 124. The magnetic dipole antenna 140 has the transmission line 125 that is connected to a test equipment (not shown) for measuring the frequency produced from the gap, z 126, between the top plate 124 and the middle plate 123. A pair of wedges 151 A and 152 B are used exert force upon a sidewall 153 and a sidewall 154, respectively, until a desirable frequency is measured by the test equipment. After the desirable frequency is detected, the wedges 151 A and 152 B maintain the sidewall 153 and the sidewall 154 in position, while glue is cured on the spacer 121 to hold the gap 126 between the top plate 124 and the middle plate 123 in place.

Figure 16:
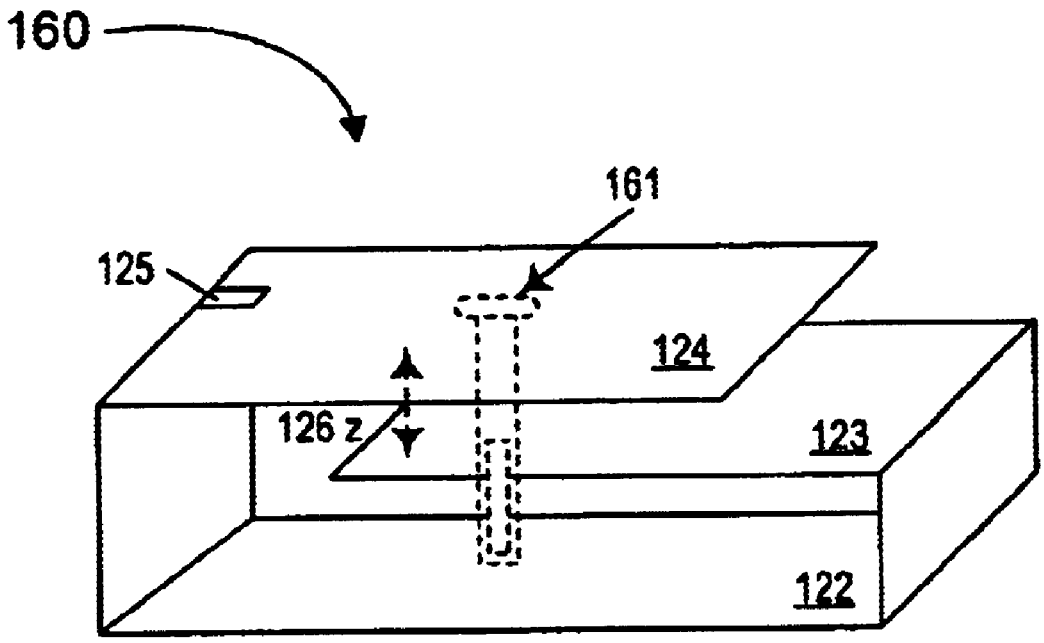
FIG. 16 is a structural diagram illustrating a magnetic dipole antenna that employs la screw from the top of the plate for adjusting a frequency in accordance with the present invention.

FIG. 16 is a structural diagram illustrating a magnetic dipole antenna that employs a screw from the top of the plate for adjusting a frequency. A screw 161 is inserted from the top plate 124, through the middle plate 123, and the bottom plate 124, for adjusting the gap z 126, thereby producing a desirable frequency from the magnetic dipole antenna 160. By screwing inward or unscrewing outward, the screw 161 changes the gap z 126 in the magnetic dipole antenna 160. Optionally, the screw 161 can also serve as a spacer as well.

Figure 17:
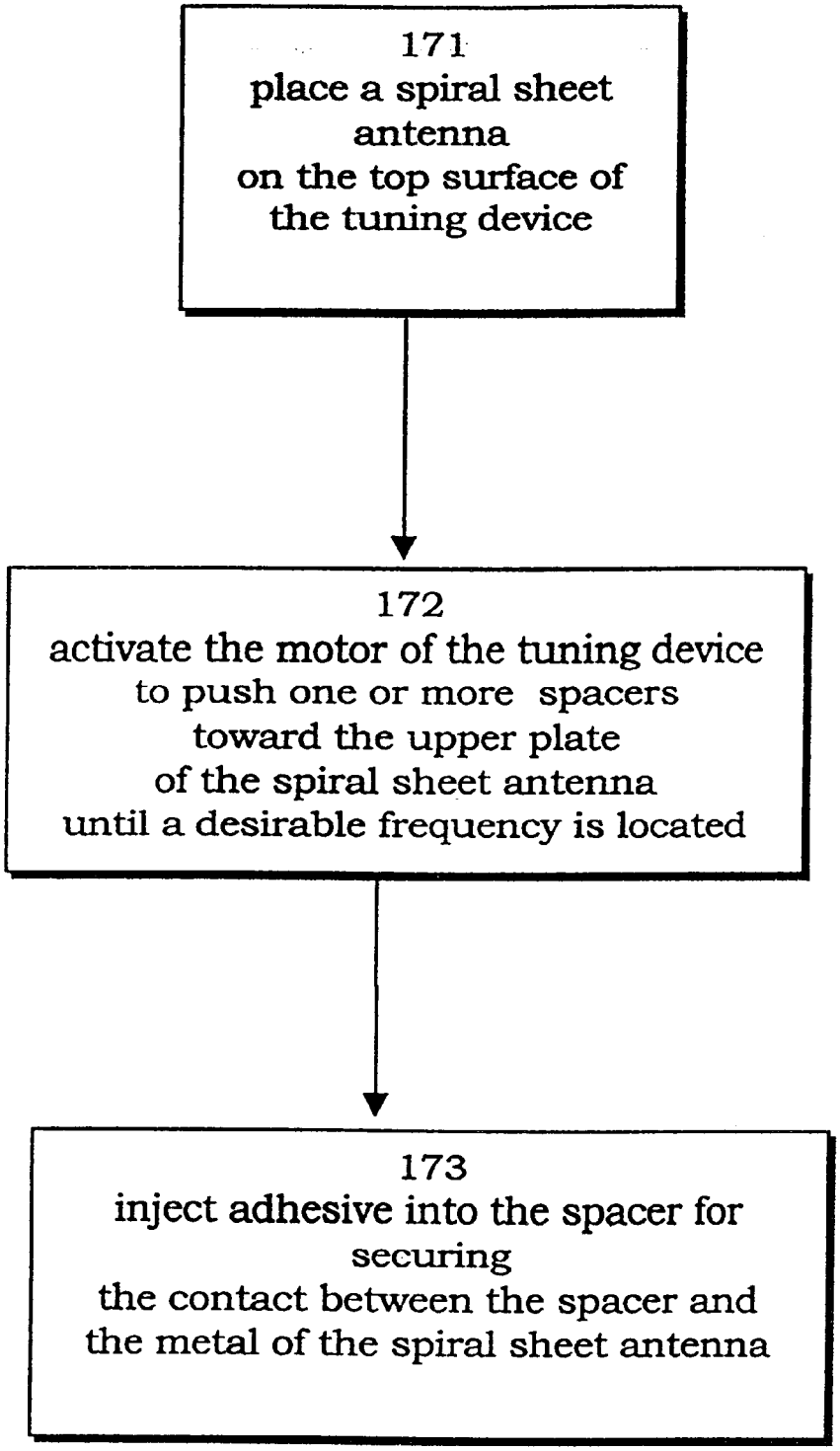
FIG. 17 is a flow chart illustrating the process for tuning an antenna frequency by adjusting the positioning of a plate for forming the capacitive element in an antenna in accordance with the present invention.

FIG. 17 is a flow chart illustrating the process 170 for tuning an antenna frequency by adjusting the positioning of a plate for forming the capacitive element of an antenna. In a step 171, the process 170 places a magnetic dipole antenna on the top surface of the tuning machine. The tuning machine activates 172 the motor for pushing one or more spacers toward the upper plate of the magnetic dipole antenna 10 until the desirable frequency is obtained. In a step 173, the process 170 injects, simultaneously or separately, adhesive into one ore more spacers, for securing the contacts between the spacers and the metal of the magnetic dipole antenna 10. It is apparent to one of ordinary skill in the art that various other methods for adjusting frequency in a magnetic dipole antenna can be used, such as the ones illustrated in FIGS. 12–16, with the pressure element 127, the magnet 131, the pair of wedges 141 and 142, the pair of wedges A 151 and B 152, and the screw.

Alternatively, it is contemplated that the present invention can be used with a different spacer form, such as rod or any kind of form. The glue may be injected on the outside and used as part of the spacer. The mechanism does not have to rely on the spacer to be pushed-in. However, one of the plates could be pushed or pulled to adjust the capacitive part. One of ordinary skill in the art should recognize that any techniques for pushing or pulling the magnetic dipole antenna, such as pushing arms coming from the top, side wedges, magnetic attraction or any kind of techniques can be practiced without departing from the spirits in the present invention.

The above embodiments are only illustrative of the principles of this invention and are not intended to limit the invention to the particular embodiments described. Accordingly, various modifications, adaptations, and combinations of various features of the described embodiments can be practiced without departing from the scope of the invention as set forth in the appended claims.

We claim:

1. A method for magnetic dipole manufacturing, comprising:

placing a magnetic dipole antenna on a top surface of a tuning device, the magnetic dipole antenna having a substantially planar top plate, a substantially planar middle plate, and a bottom plate, the substantially planar top plate and the substantially planar middle plate having a distance spacing; and adjusting the distance spacing by modifying an angle between the substantially planar top plate and the substantially planar middle plate by activating a motor of the tuning device to push one or more spacers toward the top plate of the magnetic dipole antenna until a targeted frequency is attained.

2. The method of claim 1, further comprising injecting adhesive into the one or more spacers for securing one or more contacts between the one or more spacers and the magnetic dipole antenna.

3. A method for magnetic dipole manufacturing, comprising:

providing a magnetic dipole antenna having a substantially planar top plate, a substantially planar middle plate, and a bottom plate, the substantially planar top plate and the substantially planar middle plate having a distance spacing; and adjusting the distance spacing by modifying an angle between the substantially planar top plate and the substantially planar middle plate by adjusting the distance spacing between the top plate and the middle plate with a magnet until a targeted frequency is attained.

4. A method for magnetic dipole manufacturing, comprising:

providing a magnetic dipole antenna having a substantially planar top plate, a substantially planar middle plate, and a bottom plate, the substantially planar top plate and the substantially planar middle plate having a distance spacing; and adjusting the distance spacing by modifying an angle between the substantially planar top plate and the substantially planar middle plate by adjusting the distance spacing between the top plate and the middle plate with a first wedge having a slit for exerting force against the top plate, and with a second wedge having a slit for exerting force against the middle plate until a targeted frequency is attained.

5. A method for magnetic dipole manufacturing, comprising:

providing a magnetic dipole antenna having a substantially planar top plate, a substantially planar middle plate, and a bottom plate, the substantially planar top plate and the substantially planar middle plate having a distance spacing; and adjusting the distance spacing by modifying an angle between the substantially planar top plate and the substantially planar middle plate by adjusting the spacing between the top plate and the middle plate with a first wedge for exerting force against a left sidewall of the magnetic dipole antenna, and with a second wedge for exerting force against a right sidewall of the magnetic dipole antenna until a targeted frequency is attained.

* * * * *